US006565408B1

(12) United States Patent
Marcantonio et al.

(10) Patent No.: US 6,565,408 B1
(45) Date of Patent: May 20, 2003

(54) HIGH PERFORMANCE ROLLER BEARING YO-YO

(75) Inventors: John V. Marcantonio, North Smithfield, RI (US); Dana E. Chicca, Swansea, MA (US)

(73) Assignee: Yomega Corp., Fall River, MA (US)

( * ) Notice: Subject to any disclaimer, the term of this patent is extended or adjusted under 35 U.S.C. 154(b) by 0 days.

(21) Appl. No.: 09/654,362

(22) Filed: Sep. 1, 2000

Related U.S. Application Data

(60) Provisional application No. 60/252,734, filed on Sep. 8, 1999.

(51) Int. Cl.[7] ..... A63H 1/30
(52) U.S. Cl. ..... 446/250; 446/247
(58) Field of Search ..... 446/250, 251, 446/249, 243, 247, 252

(56) References Cited

U.S. PATENT DOCUMENTS

| | | | | |
|---|---|---|---|---|
| 3,175,326 A | | 3/1965 | Isaacson | |
| 4,130,962 A | * | 12/1978 | Ennis | 446/250 |
| 4,895,547 A | | 1/1990 | Amaral | |
| 5,100,361 A | | 3/1992 | Kuhn et al. | |
| 5,254,027 A | | 10/1993 | McAvoy, Jr. | |
| 5,389,029 A | * | 2/1995 | McAvoy, Jr. | 446/250 |
| 5,951,361 A | * | 9/1999 | Van Dan Elzen et al. | 446/250 |
| 5,984,759 A | * | 11/1999 | O'Sullivan | 446/250 |
| 6,004,183 A | | 12/1999 | Dixon et al. | |
| 6,162,109 A | * | 12/2000 | Baier | 446/260 |
| 6,196,890 B1 | * | 3/2001 | Amaral | 446/250 |
| 6,196,891 B1 | * | 3/2001 | Jamison | 446/250 |
| 6,254,452 B1 | * | 7/2001 | Adler | 446/250 |

FOREIGN PATENT DOCUMENTS

| | | | | |
|---|---|---|---|---|
| JP | 411137859 A | * | 5/1999 | 446/250 |
| JP | 11253662 A | * | 9/1999 | 446/250 |
| WO | WO 00/50139 | | 8/2000 | |

* cited by examiner

*Primary Examiner*—Derris H. Banks
*Assistant Examiner*—Urszula M. Cegielnik
(74) *Attorney, Agent, or Firm*—John L. Lee

(57) ABSTRACT

A yo-yo includes a first yo-yo half defining a first starburst, a second yo-yo half defining a second starburst, and an axle fixedly mounted between said yo-yo halves. The yo-yo also includes a roller bearing fixedly attached to the axle, and a spool fixedly attached to the roller bearing, the spool having a circumferential outer rim with a groove therein. A bearing pocket defines an annular radial gap between each yo-yo half and the outer rim, the gap sufficiently small that a string cannot wedge in the gap.

8 Claims, 6 Drawing Sheets

HIGH PERFORMANCE ROLLER BEARING YO-YO

This application claims the benefit of U.S. Provisional Application No. 60/252,734 filed Sep. 8, 1999.

TECHNICAL FIELD

The invention relates to yo-yos and in particular to high performance roller bearing yo-yos.

BACKGROUND OF THE INVENTION

A typical prior art roller bearing yo-yo consists of two disk-like yo-yo halves attached at their center by an axle, and a roller bearing slidably mounted to the axle between the yo-yo halves. FIG. 6 is a cross-section view of a particular prior art roller bearing yo-yo. This yo-yo includes an axle 74, an inner shell 72 fixedly mounted to the axle by axle threaded end 80 screwed into embedded hex nut 82 of inner shell 72. Outer shell 71 is fixedly attached to inner shell 72. Roller bearing 76 is slid onto the axle and is held in place between facing rims 83 of two spacers 75. Facing rims 83 of the two spacers pinch race 84 of the roller bearing between the halves of the yo-yo. The two spacers are located in spacer pockets 73 which are defined by inner shells 72. Facing rims 87 constrain the strings axial travel on the roller bearing to prevent the string from sliding off the edges of the circumferential surface of the bearing.

Prior art roller bearing yo-yos use single loop stringing because multiple loops of string would cause binding between the bearing and spacer faces 87 and between the bearing and starburst region 88. This would prevent the yo-yo from sleeping. In the single loop stringing method, the string is merely looped around the roller bearing. This allows clearance between faces 87, thereby allowing the roller bearing yo-yo to sleep.

However, prior art roller bearing yo-yos have two disadvantages that limit performance as follows: (1) The sliding of the string around the surface of the roller bearing absorbs energy; and (2) the single loop stringing method allows the string to float from side-to-side across the relatively wide circumferential surface of the roller bearing race 85, which is undesirable because the string, not being centered, will tend to rub on facing rims 87 of the spacer and inner shell starburst regions 88.

SUMMARY OF THE INVENTION

A yo-yo according to the present invention includes a first yo-yo half defining a first starburst, a second yo-yo half defining a second starburst, and an axle fixedly mounted between said yo-yo halves. The yo-yo also includes a roller bearing fixedly attached to the axle, and a spool fixedly attached to the roller bearing, the spool having a circumferential outer rim with a groove therein. A bearing pocket defines an annular radial gap between each yo-yo half and the outer rim, the gap sufficiently small that a string cannot wedge in the gap.

DETAILED DESCRIPTION OF THE INVENTION

The present invention provides a novel roller bearing yo-yo with improved sleep time and responsiveness. Sleep time is increased by minimizing rubbing of the string against the inner surfaces of the yo-yo halves and by preventing any part of the yo-yo from rubbing against another. This is accomplished by providing a roller bearing fixedly mounted within a spool, the spool having a shaped groove such as to allow triple loop stringing. The roller bearing is fixedly mounted to the axle. The spool is fixedly mounted to the roller bearing to prevent the spool from sliding axially and rubbing against inner shells. The spool defines a peripheral groove for centering and guiding the string so it cannot float from side to side, thereby preventing rubbing of the string against inner surfaces of the yo-yo.

Responsiveness is improved by using triple loop stringing to prevent the string from sliding around the cylindrical surface of the roller bearing. As noted above, prior art roller bearing yo-yos must use single loop stringing because triple-loop stringing would prevent the prior art roller bearing yo-yo from sleeping.

A preferred embodiment of a yo-yo according to the present invention includes a first yo-yo half, a second yo-yo half, and an axle fixedly mounted between said yo-yo halves. It further includes a roller bearing fixedly attached to the axle, and a spool fixedly attached to the roller bearing. The spool defines a peripheral groove having a lead-in region. The groove is approximately three string diameters deep and a little more than one string diameter wide. The spool defines an axial aperture having flats for gripping said roller bearing.

Figure 1:
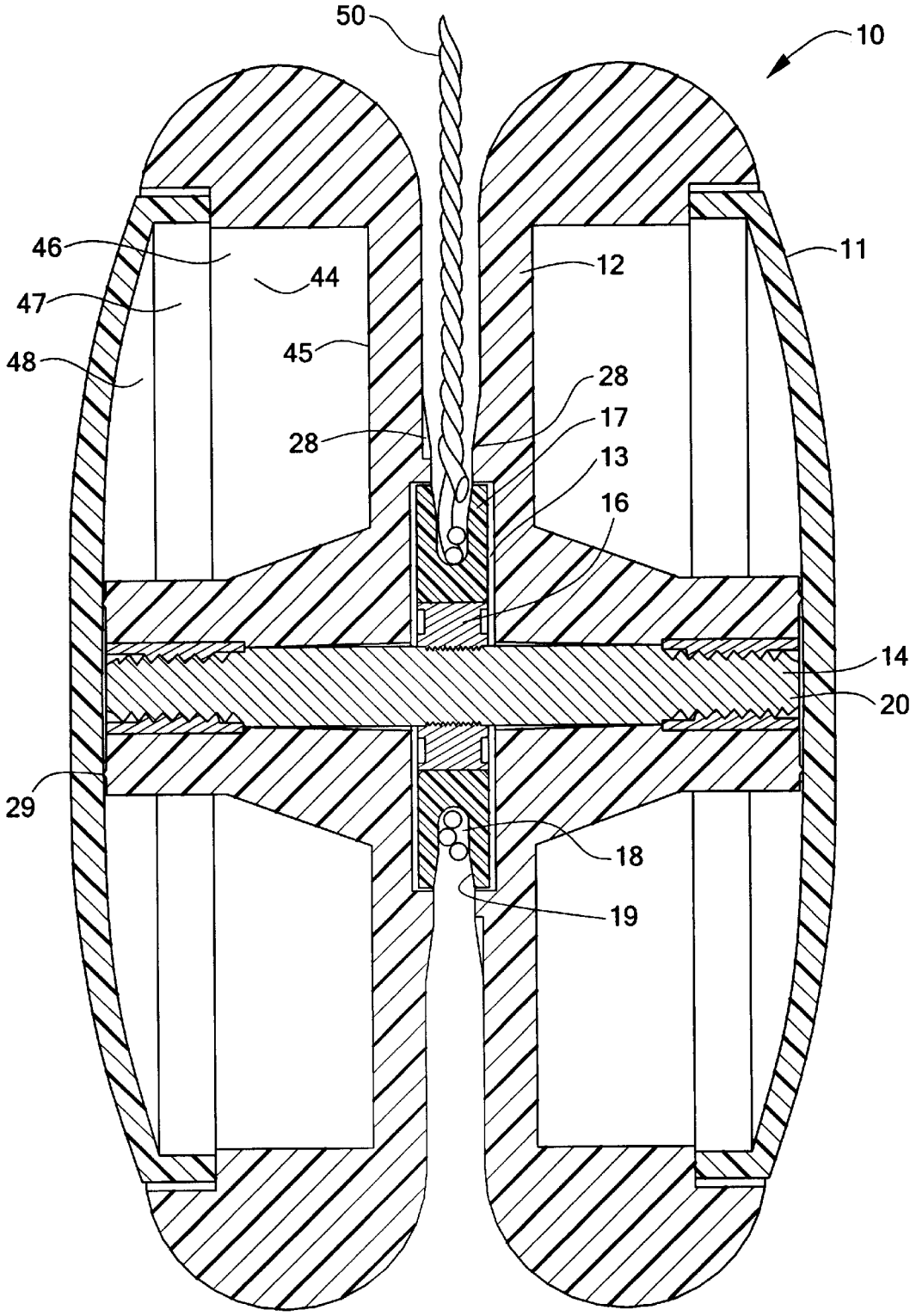
FIG. 1 is a cross section view of a preferred embodiment of a yo-yo according to the present invention.

FIG. 1 is a cross-section view of yo-yo 10 having an axle 14 and two yo-yo halves, each yo-yo half having an outer shell 11, an inner shell 12. The two inner shells define a pair of facing bearing pockets 13. Each inner shell includes an embedded hex nut 22. Axle 14 has threaded ends 20. In an assembled yo-yo each threaded end is screwed into a corresponding hex nut 22 embedded in inner shell 12. The axle also has a knurled central portion 21. A roller bearing 16 is press fitted onto the knurled portion 21 of the axle. A spool 17, having a central aperture with flats 32, is fixedly mounted onto the roller bearing. Spool 17 has a groove 18 sized to accept a yo-yo string 50 fitted by the triple loop stringing method. The groove normally holds the string centered. To prevent grabbing and snagging of the string when the yo-yo is in use, the groove has a V-shaped lead-in region 19. The inner shell defines a circular "starburst" 28 outside the diameter of bearing pocket 13. The inner shell also defines an energy director 29 for attachment of the outer shell to the inner shell by sonic welding. Each yo-yo half being essentially hollow, a cavity 44 is enclosed between outer shell 11 and inner shell 12. Cavity 44 is bounded by outer wall 45 of the inner shell, inner circumferential surface 46 of the inner shell, inner circumferential surface 47 of the outer shell, and concave surface 48 of the outer shell.

In a preferred embodiment, the groove is approximately three string diameters deep, and a little more than one string diameter wide at its base, so as to accommodate triple loop stringing. Also, the groove has a v-shaped lead-in portion having a maximum distance at its widest (distance D in FIG. 3 of no greater than the minimum distance between the facing starbursts on the two inner shells.

The lead-in portion of the groove is wide enough to accept a second wrap of string so that the user may do tricks. In this context a "wrap of string" consists of a twisted pair of cords, and a cord consists of five or more twisted strands.

Figure 2:
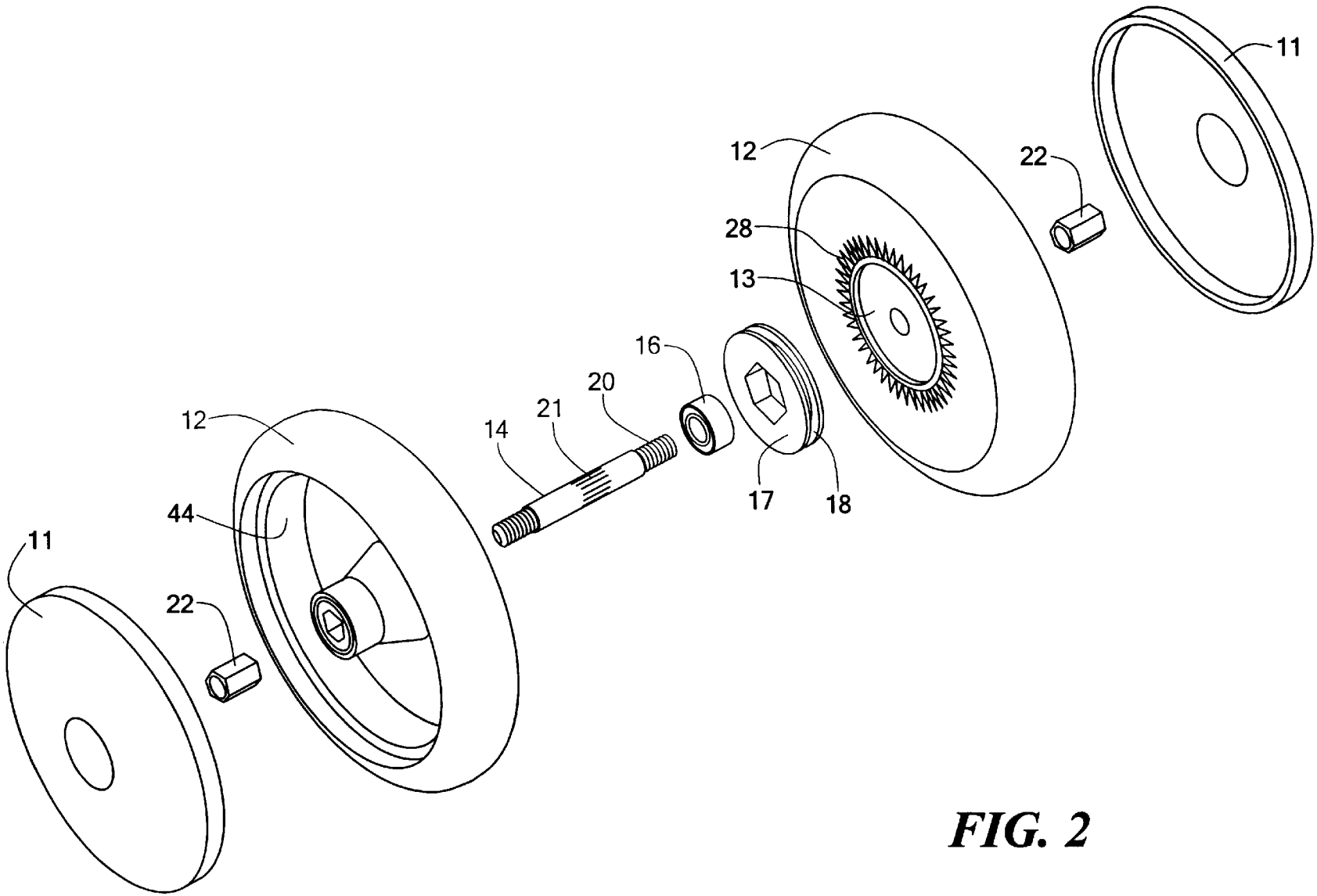
FIG. 2 is an exploded view of the components of the yo-yo of FIG. 1.

FIG. 2 is an exploded view of the components of the yo-yo of FIG. 1.

Figure 3:
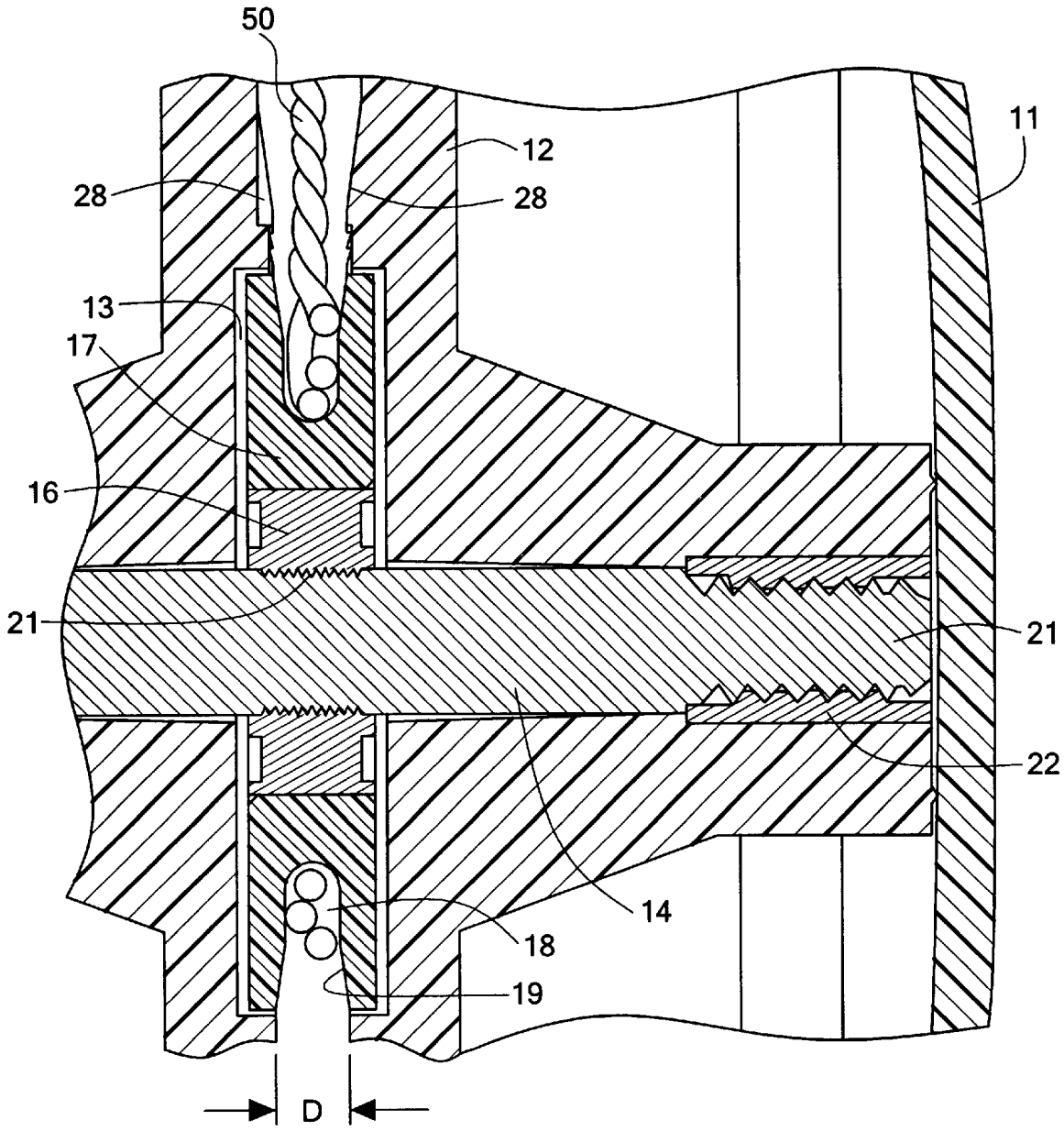
FIG. 3 is an enlarged cross section view of the bearing region of the yo-yo of FIG. 1.

FIG. 3 is enlarged cross section view of the bearing region of the yo-yo of FIG. 1.

Figure 4B:
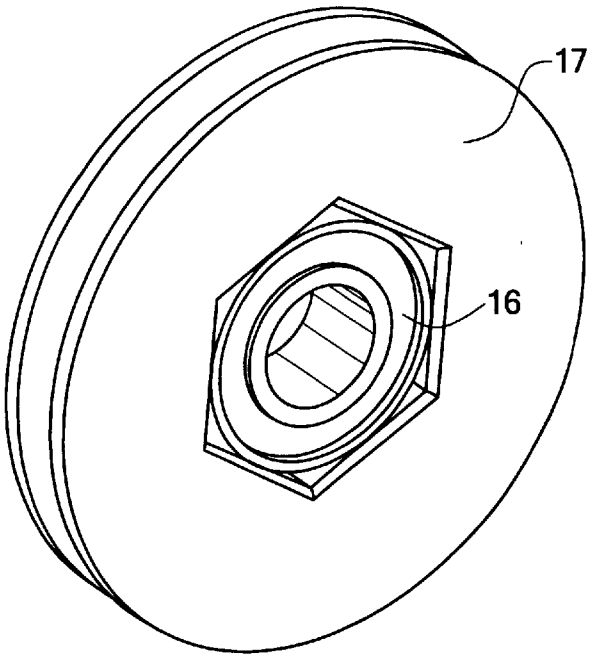
FIG. 4B is a perspective view of the assembled roller bearing and spool of the yo-yo of FIG. 1.
Figure 4A:
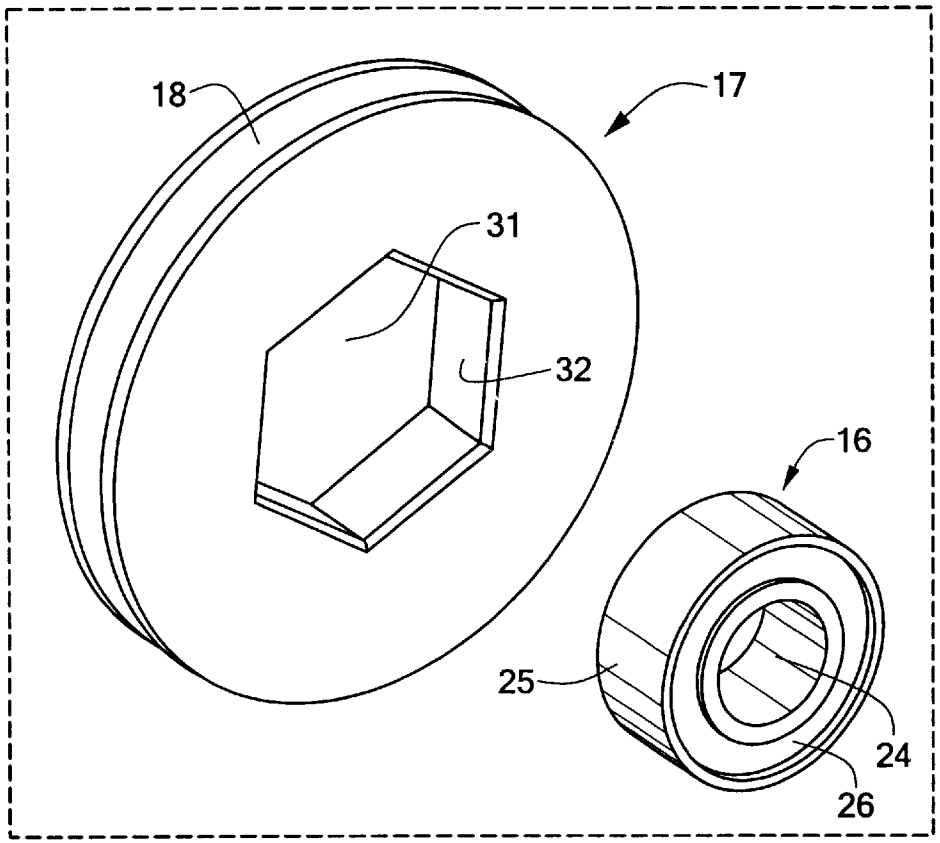
FIG. 4A is a perspective view of the roller bearing and the spool of the yo-yo of FIG. 1, prior to assembly.
Figure 5A:
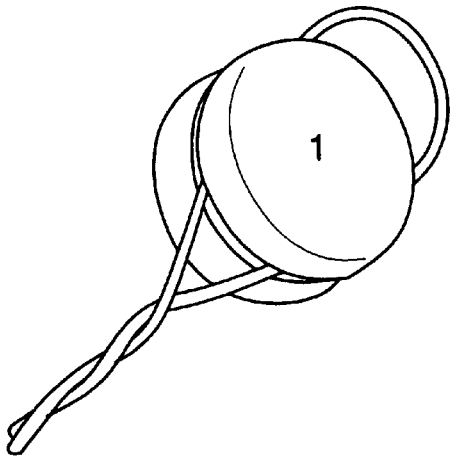
FIG. 5A PRIOR ART
FIGS. 5A-5D illustrate the known method of triple loop stringing of a yo-yo.
Figure 5B:
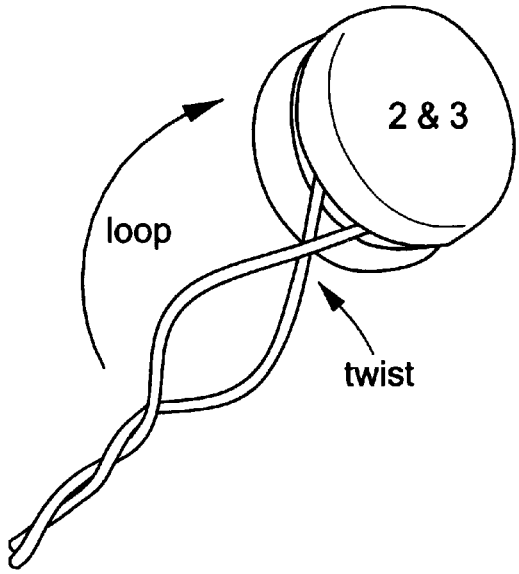
FIG. 5B PRIOR ART
Figure 5C:
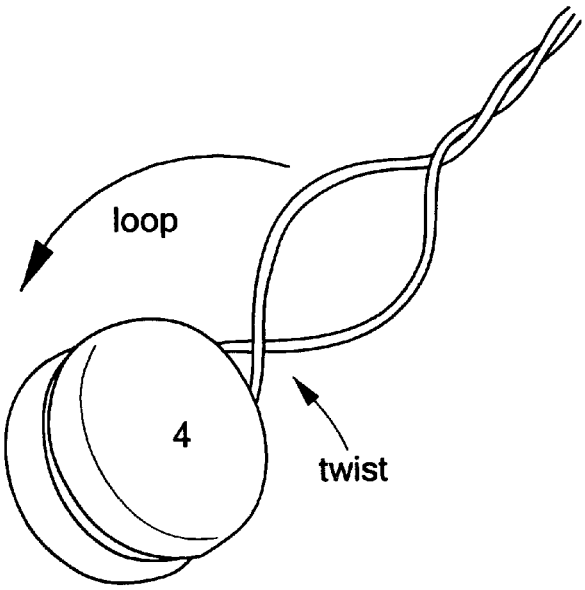
FIG. 5C PRIOR ART
Figure 5D:
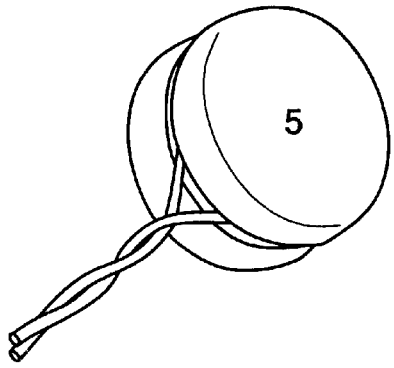
FIG. 5D PRIOR ART
Figure 6:
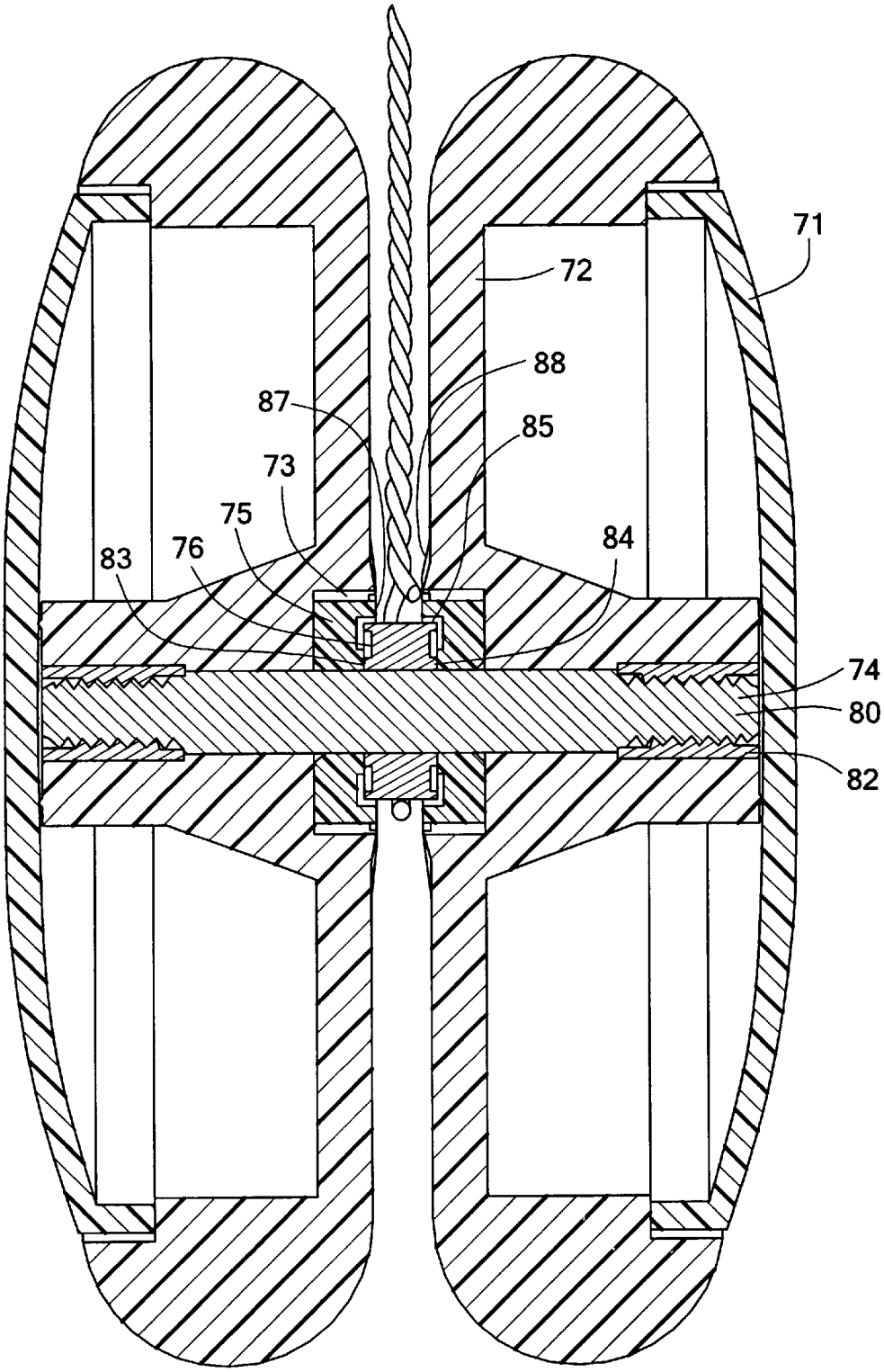
FIG. 6 PRIOR ART
FIG. 6 is a cross section view of a prior art roller bearing yo-yo.

FIG. 4A is a perspective view of the roller bearing and spool of FIG. 1, prior to assembly. Spool 17 is shown having a shaped axial aperture 31 with flats 32. Roller bearing 16 is shown having a race 24 a race 25 and a dust cover 26. The roller bearings themselves (not shown) are hidden by the dust cover. FIG. 4B shows the roller bearing press-fitted into the spool. The press fit prevents the spool from sliding along the axis. In the prior art yo-yo of FIG. 6 the rubbing is minimized. In the present invention, assuming a good straight throw, rubbing is eliminated.

The Stringing Procedure

The known stringing procedure of the double twist method (also called "triple loop stringing"), as illustrated in FIGS. 5A–5D, is as follows:

Step 1. Untwist a four-inch section at the end of the new yo-yo string, which does not have a knotted loop, and hold the string open. Place the string over the axle of the yo-yo and continue to hold open.

Step 2 & 3. Twist the string, by crossing over the strands, and then loop it over the yo-yo.

Step 4. Twist and loop again.

Step 5. Allow the natural twist of the string to resume its former position.

What is claimed is:

1. A yo-yo comprising:

a first yo-yo half defining a first starburst;

a second yo-yo half defining a second starburst;

an axle fixedly mounted between said yo-yo halves;

a roller bearing fixedly attached to said axle; and a spool having an inner surface fixedly attached to said roller bearing, and a circumferential outer rim with a groove therein;

wherein said first yo-yo half and said second yo-yo half define a bearing pocket having a annular radial gap between each yo-yo half and said outer rim, said gap sufficiently small such that a string cannot wedge in said gap.

2. A yo-yo according to claim 1, wherein said groove includes a lead-in region having a V-shaped cross section defining an angle of less than 45°.

3. A yo-yo according to claim 1, wherein said spool defines an axial aperture having flats for gripping said roller bearing.

4. A yo-yo according to claim 2, wherein said groove is wide enough and deep enough to accept a second wrap of string.

5. A yo-yo comprising:

a first yo-yo half defining a first starburst;

a second yo-yo half defining a second starburst;

an axle fixedly mounted between said yo-yo halves;

a roller bearing fixedly attached to said axle; and a spool fixedly attached to said roller bearing, said spool having a peripheral rim portion that is radially separated by a distance substantially less than one string diameter from an adjacent cylindrical face of each yo-yo half.

6. A yo-yo according to claim 5, wherein said groove is wide enough and deep enough to accept a second wrap of string.

7. A yo-yo according to claim 5, wherein said groove is an annular groove, appearing in cross section as a v-shaped notch having a u-shaped base region, the u-shaped base region defining in part a segment of a circle having a diameter greater than one string diameter.

8. A yo-yo comprising:

a first yo-yo half defining a first starburst;

a second yo-yo half defining a second starburst;

an axle fixedly mounted between said yo-yo halves;

a roller bearing fixedly attached to said axle; and a spool having an inner surface fixedly attached to said roller bearing, and a circumferential outer rim with a groove therein;

wherein said groove includes a lead-in region having a v-shaped cross section defining an angle of less than 45°.

* * * * *